United States Patent [19]

Lotspeich

[11] 4,061,245

[45] Dec. 6, 1977

[54] HELICAL COIL DISPENSING MACHINE APPARATUS

[75] Inventor: Joseph A. Lotspeich, Eagen, Minn.

[73] Assignee: Gross-Given Manufacturing Company, St. Paul, Minn.

[21] Appl. No.: 669,348

[22] Filed: Mar. 22, 1976

[51] Int. Cl.[2] ..... G07F 11/36

[52] U.S. Cl. ..... 221/75

[58] Field of Search ..... 221/75; 194/10

[56] References Cited

U.S. PATENT DOCUMENTS

| | | | |
|---|---|---|---|
| B 510,281 | 3/1976 | Cox et al. | 221/75 |
| 3,441,174 | 4/1969 | Kenney | 221/75 |
| 3,591,045 | 7/1971 | Sturrock | 221/75 |
| 3,653,540 | 4/1972 | Offutt | 221/75 |
| 3,840,147 | 10/1974 | O'Neal et al. | 221/75 |
| 3,929,255 | 12/1975 | Wittern et al. | 221/75 |
| 3,952,915 | 4/1976 | Pitel et al. | 221/75 |

*Primary Examiner*—Stanley H. Tollberg
*Assistant Examiner*—Fred A. Silverberg
*Attorney, Agent, or Firm*—Charles E. Golla

[57] ABSTRACT

Improved dispensing apparatus for dispensing machines of the type having at least one dispensing tray containing a dispensing unit which dispenses articles from the machine by the use of a helical dispensing coil. Improved mounting apparatus is provided for supporting both the forward and back end portions of the dispensing coil. A cross-bracket member having a portion extending across the diameter of the coil, is mounted to the back portion of the coil. A cross-bracket holding device, connected for rotation by appropriate motor means, releasably accepts the cross-bracket for mounting the back portion of the coil in elevated position above the shelf surface of the dispensing tray. The cross-bracket holding device is configured to matingly accept differently sized cross-bracket members, to enable rapid interchangeability of differently sized dispensing coils in the machine. Coil support apparatus mounted to slidably engage the outer circumference of the dispensing coil near its forward end supports the forward end of the coil in elevated spaced-apart manner above the tray surface, and supports the coil in a manner which minimizes jamming of the items being dispensed at the forward end of the coil. Coil compression means mounted adjacent the forward end of the dispensing coil causes the coil to positively eject or to impart dispensing motion to the item being dispensed from the convolutions of the coil, during the dispensing rotation movement of the coil.

26 Claims, 14 Drawing Figures

HELICAL COIL DISPENSING MACHINE APPARATUS

BACKGROUND OF THE INVENTION

Use of helical coil in vending machines as a means for transporting an item to be vended from a location within the machine to a point of discharge from the machine, by rotation of the vending coil has long been known. See for example U.S. Pat. No. 3,269,595. Typically, the vending coil has been used in conjunction with a horizontal support tray, wherein the item to be vended is placed within the windings of the vending coil and is supported by the tray. By rotating the vending coil, the item to be vended is longitudinally advanced along the tray, under force from the windings of the vending coil until it reaches the front end of the tray. Upon further rotation of the vending coil, the item to be vended is forced over the edge of the tray and falls into a discharge bin.

Early prior art vending machines of this type were configured to mount the support trays within the helical coil. This configuration, however, was particularly susceptible to problems resulting when the package to be vended got caught between the vending coil and the tray. Upon reaching the front edge of the tray, rather than falling into the discharge bin, the items so caught would hang-up at the front end of the vending coil, thus jamming the coil discharge mechanism. Various techniques have been used to eliminate this type of problem. For the most part, such techniques have incorporated means for supporting the vending coil above the tray so as to prevent the items being vended from getting caught between the vending coil and the tray. Further, to alleviate the jamming problem at the discharge end of the coil, most prior art techniques included extending the length of the vending coil significantly past the end of the support tray.

However, such prior art techniques have caused problems of their own. The coil support means have typically taken up space within the windings of the vending coil and have necessitated using large support members, requiring significantly more material, and thus increasing the cost of the machine. Further, such techniques have not totally solved the problem of items being caught, since oftentimes the items being vended will still lodge between the vending coil and the support apparatus itself, thus jamming the coil discharge apparatus. The present invention provides apparatus which minimizes the above problems associated with prior art vending machines.

Another disadvantage to many of the helical coil type vending machines of the prior art is the incapability in such machines to interchange their coils. If maximum use is to be made of available tray area, differently sized coils are required for items having different package sizes. The present invention contemplates the use of at least two basic coil sizes, one for items having larger, bulkier packages such as pastries and potato chips, and a second for smaller less bulky packages of items such as candy bars.

Still another disadvantage of the helical coil vending machines of the prior art is that with such devices, upon reaching the discharge end of the tray, the item to be vended does not always fall freely from the tray. This is particularly troublesome with items having a relatively tall package dimension. When such packages are slowly pushed forward by the helical coil and dropped over the edge of the support shelf, they tend to tip forward, rather than falling straight down, and oftentimes become wedged between the outer cabinet of the machine and the leading edge of the support tray. Such a jam typically requires maintenance and, denies the purchaser of that item for which he has paid. The present invention solves the problem by providing a positive item ejection apparatus.

SUMMARY OF THE INVENTION

The present invention solves the above problems associated with prior art vending machines. This invention includes coil support apparatus which minimizes the probability of an item package getting caught between the coil and its associated support tray. This invention also provides for the interchangeability between coils of various sizes and incorporates means designed to assure a smooth discharge of the vended item from the tray.

The present invention comprises an improved vending machine of the type utilizing helical vending coils and associated support trays for delivering items to be vended fron positions upon the respective trays within the vending machines to the leading or forward edges of the trays, from edges the items fall into a discharge bin. The invention includes an improved vending coil unit, a plurality of which units are placed along side one another within the machine, with each coil overlying an associated support tray or shelf. Each vending coil unit comprises a helical vending coil connected at one end thereof to a cross-bracket member. The cross-bracket member is secured by a bracket holding device near the back portion of the vending machine. The bracket holding device is connected to a rotatable shaft operatively connected for rotation by an electric motor. The opposite end of the coil is supported near the front of the machine by a coil support apparatus which is mounted at the forward edge of that shelf surface defined by a tray longitudinally disposed to underly the coil. The coil support apparatus is inclined at an angle to the shelf surface for enabling the smooth discharge of the item to be vended. The coil support apparatus is configured to support the vending coil above and out of contact with the underlying shelf surface. In one preferred embodiment, each vending coil unit comprises means for positively ejecting a vended item from its respective vending coil to assure free fall of the vended item from the edge of the shelf surface and into a discharge bin.

BRIEF DESCRIPTION OF THE DRAWING

Referring to the Drawing, wherein like numerals represent like parts throghout the several views.

DESCRIPTION OF THE PREFERRED EMBODIMENT

Figure 1:
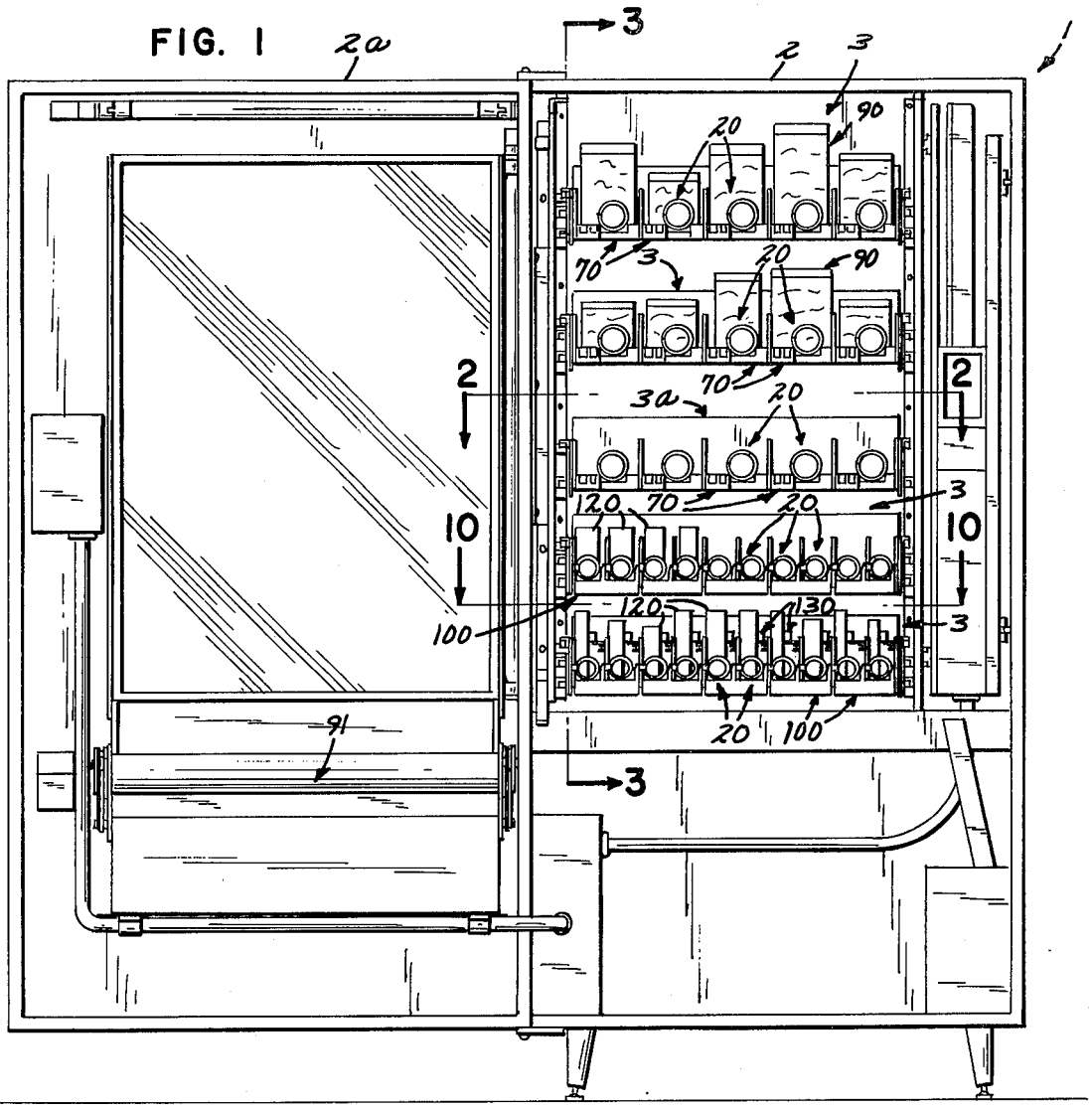
FIG. 1 is a view in front elevation of a vending machine of the present invention showing a possible arrangement of a plurality of support trays within the vending machine and a plurality of vending coil units overlying the respective support trays.
Figure 3:
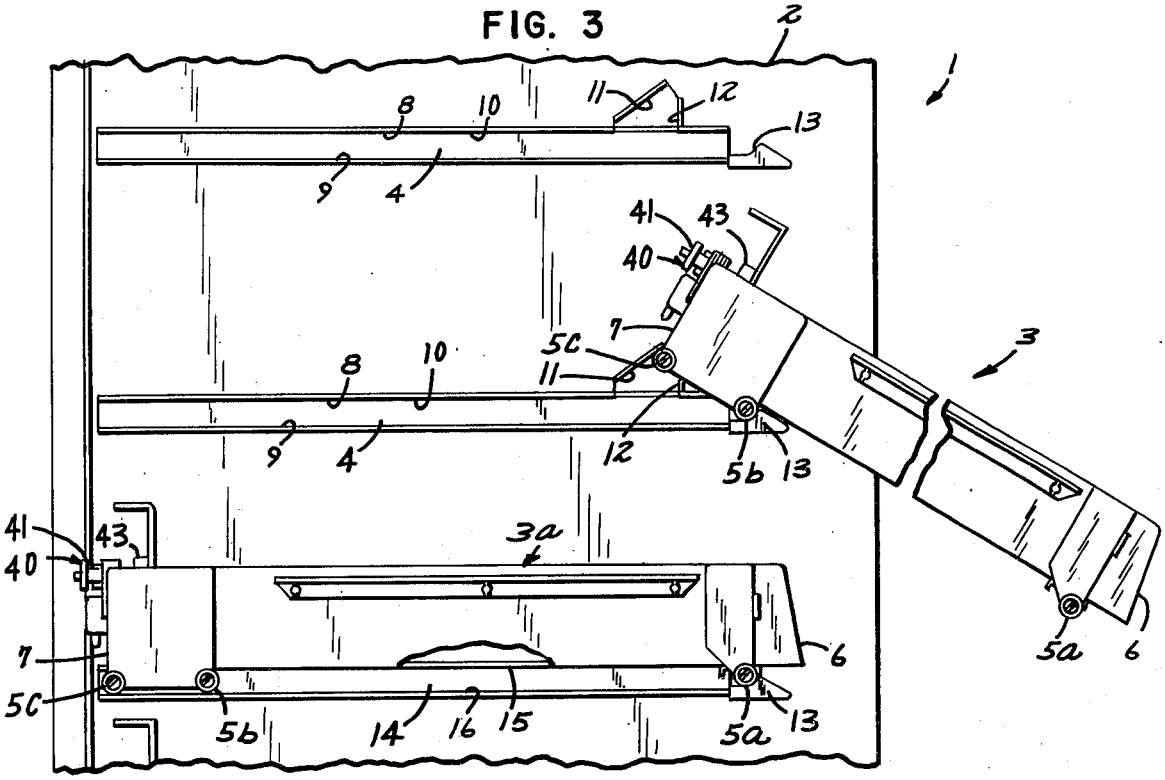
FIG. 3 is a view in side elevation of a portion of the interior of the vending machine disclosed in FIG. 1, viewed generally along the plane of the Line 3—3 in FIG. 1, illustrating one of the vending coil units in extended position for loading thereof or preparatory to removal thereof from the machine.

Referring to the Drawing, wherein like numerals represent like elements throughout the several views, there is shown in FIG. 1 a dispensing machine 1 having an outer housing 2 with a plurality of dispensing trays 3 slidably mounted therein. The vending machine 1 also has a front door member 2(*a*) (illustrated in open position in FIG. 1)pivotally mounted to the outer housing 2, which door member is normally positioned to enclose the trays within the internal cavity of the housing 2. Since the support apparatus for each of the trays 3 is of generally identical construction, only one tray will be described, it being understood that the remaining trays 3 are of like construction and function. Referring to FIG. 3, each dispensing tray 3 is mounted within the housing 2 by means of a plurality of rollers 5(*a*)-5(*c*) respectively that travel within a pair of channels 4 attached to the interior of the outer housing 2. On each side of the trays 3 there is a front roller 5(*a*) located near the front portion 6 of the tray 3, a first rearwardly disposed roller 5(*b*) and a second rearwardly disposed roller 5(*c*) located near the back portion 7 of the tray 3. The first rear roller 5(*b*) is located forward of the second rear roller 5(*c*). Each guide channel 4 includes a top support surface 8 and a bottom support surface 9. The bottom support surface 9 of the channel 4 extends generally horizontally along its entire length, while the top support surface 8 includes an elongate horizontally disposed portion 10 located rearward of an inclined ramp portion 11, which is disposed toward the forward portion of the channel 4. The inclined ramp portion 11 enables the second rear roller 5(*c*) to vertically lift upward when the tray is pulled sufficiently forward, resulting in a pivoting of the forward portion 6 of the tray 3 in a downward direction about the axis of the first rear roller 5(*b*). Loading of articles to be dispensed is facilitated when the tray is pulled in its outermost downwardly tipped position, as illustrated in FIG. 3. A pair of stop members 12 and 13, mounted to the guide channel 4, engage the first and second rear rollers 5(*b*) and 5(*c*) respectively when the tray 3 is fully extended in its tipped-down position, to prevent removal of the tray from the guide channels 4 (see FIG. 3). Stop member 13 also engages the front roller 5(*a*) when the tray 3 is positioned in fully inserted position within the housing 2 to retain the tray 3 in its normally operative position.

The preferred embodiment of the present invention contains five trays 3 located within the outer housing 2. In the preferred embodiment, it has been found that the most advantageous arrangement of the trays 3 is to provide all except the middle tray 3(*a*) with the above-described tip-down mechanism. The middle tray 3(*a*) (FIGS. 1 and 3) is supported in side channels 14 having both the top surface 15 and the bottom support surface 16 thereof disposed generally horizontally along the entire length of the channels 14. Therefore, the middle tray 3(*a*) will not tip down when pulled forward in its fully extended position.

Figure 2:
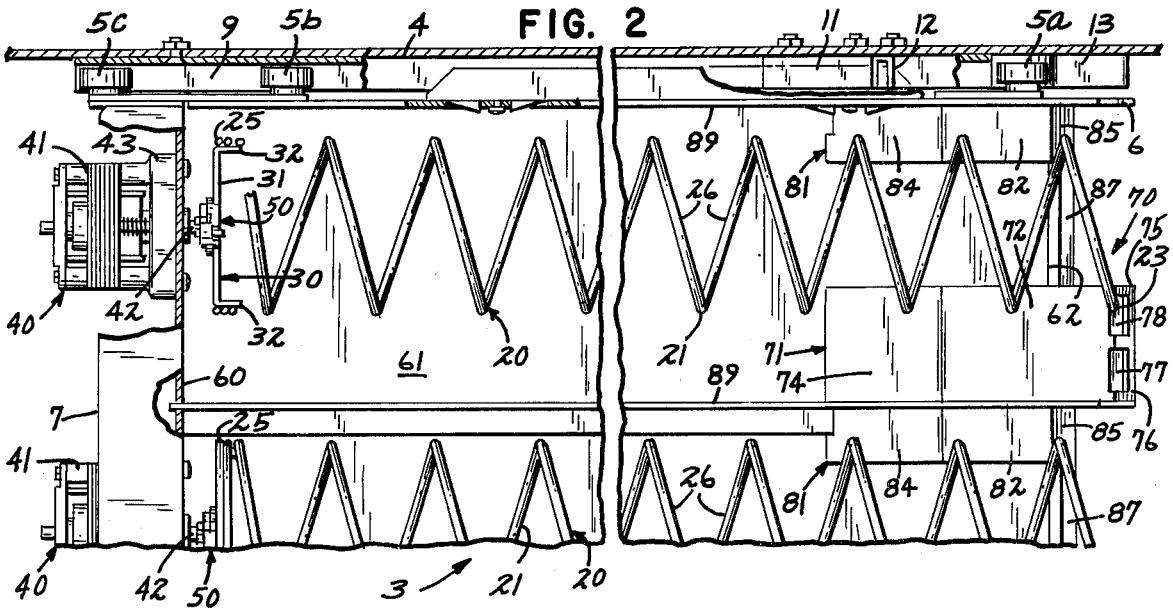
FIG. 2 is a fragmentary top plan view of a portion of one of the support trays of the vending machine disclosed in FIG. 1, as generally viewed along the plane of the Line 2—2 in FIG. 1.
Figure 10:
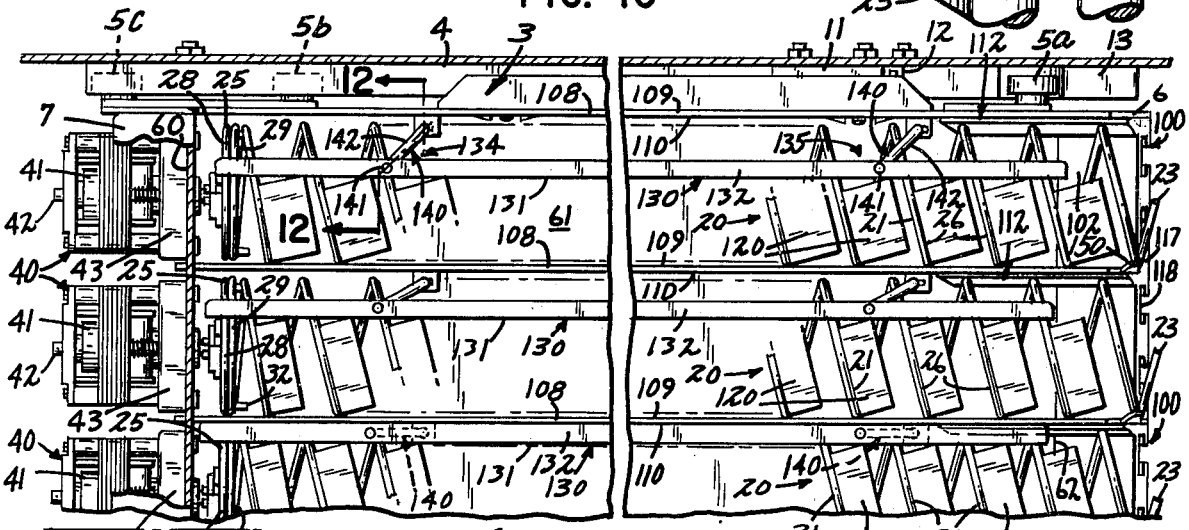
FIG. 10 is a fragmentary sectional view of the lower vending coil units and underlying support trays of the vending machine disclosed in FIG. 1, generally as viewed along the Line 10—10 of FIG. 1.
Figure 11:
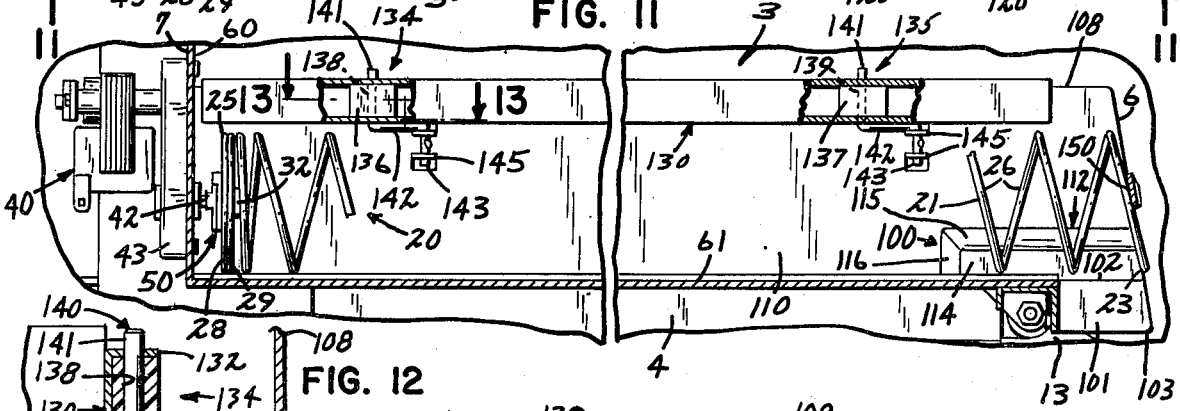
FIG. 11 is a fragmentary sectional view of a vending coil unit disclosed in FIG. 10, generally taken along the Line 11—11 of FIG. 10.

Each of the dispensing trays 3 contains a plurality of dispensing coil units 20. Each dispensing coil unit 20 contains an elongate generally rigid helical dispensing coil 21 having a generally circular cross-section and a front portion terminating in a first terminal 23 and a rear portion terminating at a second terminal 25. A continuous coil 21 contains a plurality of regularly spaced convolutions or windings 26. The inter-convolution spacing between the windings 26 of the dispensing coils 21 toward the rear portion thereof are rapidly decreased such that the last winding 28 directly abuts the next-to-the-last winding 29 (see FIGS. 2, 10, and 11).

A cross-bracket 30 is welded or otherwise fixedly attached to the rear portion of each vending coil 21 across the inner diameter of the last winding 28 of the coil (see FIGS. 2, 4, 7, 10 and 15). The cross-bracket 30 has a planar cnetral portion generally designated at 31 and two end portions 32, projecting generally perpendicularly to the central portion 31. The length of the middle portion 31 of the cross-bracket 30 equals the inner diameter of the last winding 28 of the coil 21 and has a hole 35 positioned at its longitudinal center. The end portions 32 of the cross-bracket 30 are of sufficient length to permit attachment thereof to at least the last winding 28 of the vending coil 21, by welding or other means, and preferably are of sufficient length to extend into the inner diameter of the coil 21 so as to engage and be connected to several windings thereof (see FIG. 10). When mounted to a coil 21, the longitudinal axis of the coil passes through the center of the hole 35 in the cross-bracket 30.

Figure 7:
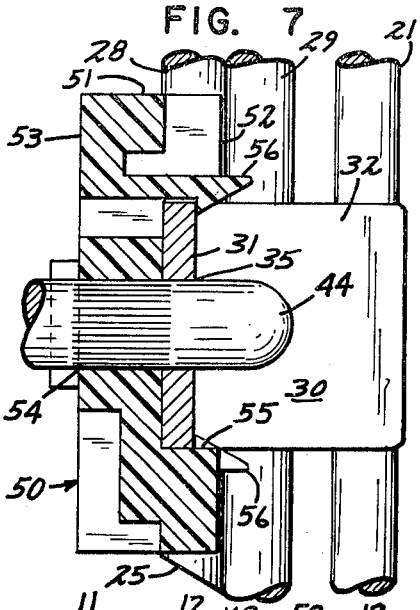
FIG. 7 is a fragmentary sectional view of the securing mechanism for the rear portion of the vending coil disclosed in FIG. 4, generally as viewed along the Line 7—7 of FIG. 4.
Figure 8:
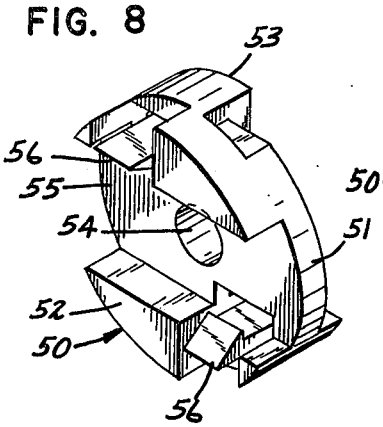
FIG. 8 is a perspective view of the cross-bracket holding device disclosed in FIG. 7.
Figure 9:
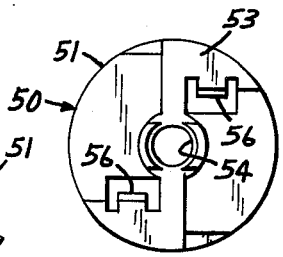
FIG. 9 is a view in rear elevation of cross-bracket holding device disclosed in FIG. 8.

Appropriate motor means, generally designated at 40, are provided for rotating the vending coil 21. In the preferred embodiment, the motor means 40 includes an electric motor 41 which rotates a shaft 42 either directly or through an appropriate gear reducing apparatus 43. The shaft 42 has a rounded protruding knurled end 44 (FIG. 7) to provide a frictional compression engagement fit with a cross-bracket holding device 50. Referring to FIGS. 7–9 the cross-bracket holding device 50 comprises a disc-like outer portion 51 having a front lateral surface 52 and a rear lateral surface 53. A hole 54 passes through the center of the cross-bracket holding device 50 so as to receive and to frictionally engage the knurled end 44 of the shaft 42. The front lateral surface 52 of the cross-bracket holding device is recessed to form a channel 55 having a width equal to that of the cross-bracket 30 such that when the cross-bracket holding device 50 is mounted to the shaft 42, the end 44 of the shaft 42 will be aligned with and will matingly engage the hole 35 located in the middle portion 31 of the cross-bracket 30, enabling the central portion 31 of the cross-bracket to cooperatively engage the channel 55 of the cross-bracket holding device 50 and to be seated therein.

The cross-bracket holding device 50 is provided with two retaining clips 56 mounted adjacent to the channel 55 on diametrically opposed sides thereof. Each of the retaining clips 56 is operable between a first and a second position, and is normally biased toward operation in its first position to retainably engage the cross-bracket member 30 within the channel 55 and is movable to its second position for releasing and/or for accepting the cross-bracket member 30 respectively from and into retention within the channel 55.

The motor means 40 for each tray 3 are mounted to a support wall 60 disposed across and forming a rear portion 7 of each tray 3. The motor means 40 are mounted to the support walls 60 such that the shaft 42 projects therethrough at a position sufficient to support the rear portion of a vending coil 21 (which is properely mounted to the cross-bracket holding device 50 as above-described), above and spaced apart from the lower shelf surface 61 of the tray 3, (see FIGS. 4–6). The forwardly disposed portion of each coil 21 is also supported in a manner such that the lower portion of the coil 21 overlies and is spaced apart from the tray shelf surface 61. Support of the forwardly disposed portions of the dispensing coils 21 is accomplished by use of novel coil support apparatus of this invention, two preferred embodiments of which are described below.

Figure 4:
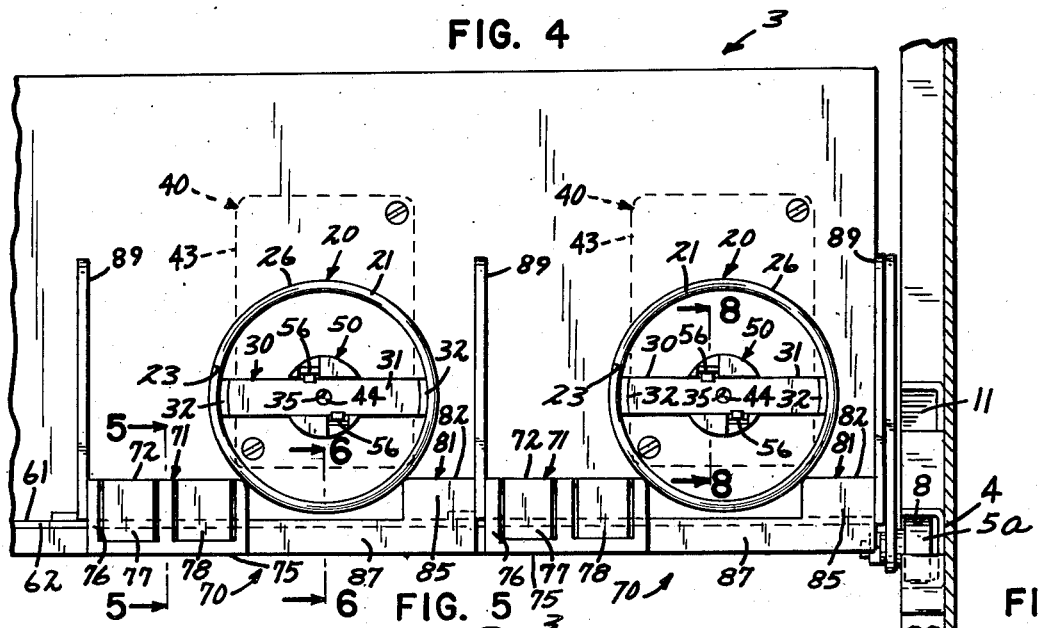
FIG. 4 is an enlarged fragmentary view in front elevation of a vending coil unit and its associated underlying tray, as disclosed in FIG. 1, and constructed according to the principles of this invention.
Figure 5:
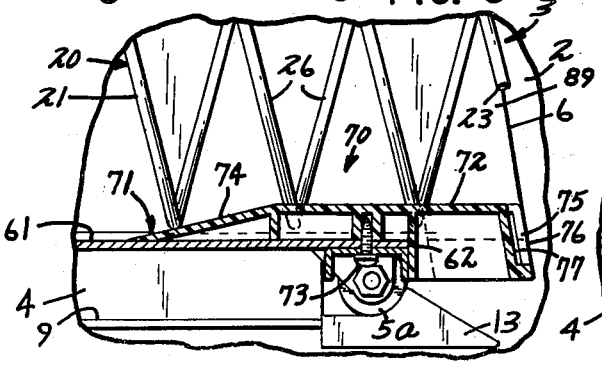
FIG. 5 is a fragmentary sectional view of a portion of the vending coil unit and underlying support tray disclosed in FIG. 4, generally taken along the Line 5—5 in FIG. 4.
Figure 6:
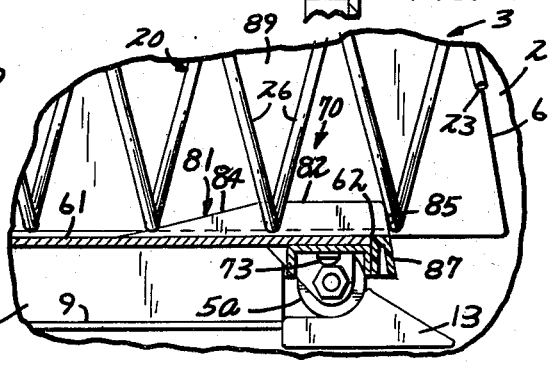
FIG. 6 is a fragmentary sectional view of the vending coil unit and underlying support tray disclosed in FIG. 4, generally taken along the Line 6—6 of FIG. 4.

Referring to FIGS. 4–6, a first preferred embodiment of a coil support apparatus for the forwardly disposed portion of a coil 21 is disclosed at 70. The coil support apparatus 70 is configured for mounting upon the shelf surface 61 and for engagement to and against the front edge 62 of the shelf 61. The coil support apparatus 70 includes a first elongate coil support member 71 having a base portion defining a first planar upper surface 72 disposed to lie above and generally parallel to the shelf surface 61. The first coil support member 71 is mounted in fixed engagement to the shelf surface 61 by means of a mounting stud 73 which projects through the shelf surface and into cooperatively mating engagement with the base portion of the first coil support member 71. The first coil support member 71 has a ramp surface 74 rearwardly extending from the planar upper surface 72 of the support member 71 to the shelf surface 61, forming a smooth continuous path between the shelf surface 61 and the planar upper surface 72 of the support member 71. The forward end of the support member 71 is terminated at an end portion 75 disposed forward of the front edge 62 of the shelf 61 at a distance approximately equal to the longitudinal distance between consecutive convolutions of the helical coil 21 to be supported by the support apparatus 70.

The coil support apparatus 70 further has a second coil support member 81 configured for mounting upon the shelf surface 61 and aligned parallel with and spaced apart from the first coil support member 71. The second coil support member 81 has a base portion defining a second planar upper surface 82 disposed to lie above and generally parallel to the shelf surface 61, and at a height such that the planar upper surfaces 72 and 82 of the first and second coil support member 71 and 81 respectively are generally co-planar. The second coil support member 81 is mounted in fixed engagement to the shelf surface 61 by means of a mounting stud 73 which projects through the shelf surface 61 and into cooperative mating engagement with the base portion of the second coil support member 81. The second coil support member 81 has a ramp surface 84 rearwardly extending from the planar upper surface 82 of the support member 81 and down to the shelf surface 61, forming a smooth continuous path between the shelf surface 61 and the planar upper surface 82 of the support member 81. The first and second support member 71 and 81 of the coil support apparatus 70 are disposed such that their respective ramp surfaces 74 and 84 are generally co-planar. The foward end of the support member 81 is terminated at a leading end portion 85 disposed to lie slightly forward of but adjacent the front edge 62 of the shelf 61, and longitudinally spaced back from the leading end portion 75 of the first support member 71 by approximately the longitudinal spacing between successive convolutions of the coil 21.

The first and second coil support members 71 and 81 respectively are fixedly connected in parallel spaced-apart alignment with one another by means of a beam member 87 laterally disposed between the first and second support members 71 and 81 respectively. The back surface of the beam member 87 is configured to matingly engage the front edge 62 of the shelf 61, and the top surface of the connecting beam member 87 is aligned co-planar with the shelf surface 61 to form a continuous sliding surface therewith. In the preferred embodiment, the forward edge of the connecting beam 87 is co-planar with the forward end surface 85 of the second coil support member 81. The back edge of the beam member 87 continuously laterally projects across and under the base portions of both the first and second coil support members 71 and 81 respectively, to provide continuous alignment engagement of the support beam 87 with the front edge 62 of the shelf 61 across the entire lateral dimension of the coil support apparatus 70. The first and second support members 71 and 81 respectively are laterally spaced apart from one another so as to cooperatively support by means of the inwardly disposed edges of their upper planar surfaces 72 and 82 respectively one of the helical coils 21 such that the lower surface of the supported coil is disposed to lie above and spaced apart from the shelf surface 61. In the preferred embodiment, the coil support apparatus 70 is constructed of durable plastic material, however, any other suitable material could be equally well employed within the spirit and intent of this invention.

The forward end portion 75 of the first coil support member 70 includes a display panel 76. In the preferred embodiment, the display panel 76 includes a first generally vertically oriented slot 77 and a second generally vertically oriented slot 78, suitable for accepting plastic or paper tab inserts (not illustrated) on which visual information such as product identification or price information can be visually displayed.

The above-described coil support apparatus 70 is particularly well suited for use in the dispensing of items having large, bulky packages such as potato chips and pastries. It should be noted that the coil support apparatus 70 need not extend over the entire length of the coil 21 which it supports, but is disposed to support the coil 21 only along a relatively short length thereof near its forwardly disposed end. Side panels 89 are placed between each of the dispensing coil units 20 and are mounted to the underlying shelf 61, and extend from the front portions 6 to the rear portions 7 of the respective trays 3. The side panels 89 function to provide laterial guide support for items to be dispensed in a forward direction upon the rotation of the vending coil 21 about its longitudinal axis, and maintain separation of dispensible items between adjacent ones of the dispensing coil units.

When the dispensing machine 1 is in operative use, the items to be dispensed, generally designated at 90 in FIG. 1, are loaded into the dispensing coil units for disposition between consecutive convolutions of the dispensing coils, as illustrated in FIG. 1. A purchaser selects that item he desires dispensed, by electrical control apparatus not disclosed herein, but of any type well known in the art of vending and dispensing machines, which control apparatus effects an energization of the motor means of the dispensing coil 21 which contains that selected dispensable item. The motor means 40 causes rotation of the selected coil 21 a predetermined number of rotational degrees (generally one full revolution) to effect a dispensing discharge or vend of the selected item to the purchaser. In operation of the preferred embodiment of the dispensing coil unit above described, as the dispensing coil 21 is rotated, the item to be dispensed travels in a forward direction along the winding 26 of the dispensing coil 21. Until reaching the coil support apparatus 70, the item to be dispensed is vertically supported by the underlying shelf surface 61. Upon reaching the coil support member 70 the item to be dispensed engages and is guided upwardly by the first and second ramp surfaces 74 and 84 respectively of the first and second coil support members 71 and 81, and is thereafter longitudinally guided along the upper planar surfaces 72 and 82 respectively thereof. When the item to be dispensed reaches the forward end portion 85 of the second coil support apparatus 81, the item package is caused to be tipped in the direction of the second coil support member 81, and falls by action of gravity from the retaining convolution of the support coil 21 and from the tray 3 into a discharge bin 91 of the machine 1, where it is retrieved by the purchaser.

Figure 15:
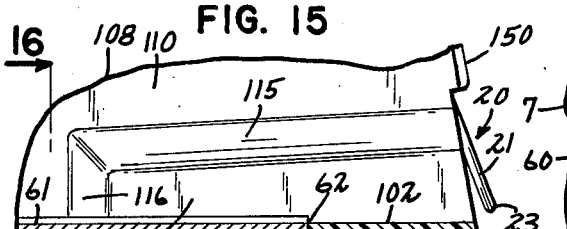
FIG. 15 is a fragmentary sectional view of a support ramp member for the vending coil of the vending coil disclosed in FIG. 14, generally taken along the Line 15—15 of FIG. 14.
Figure 14:
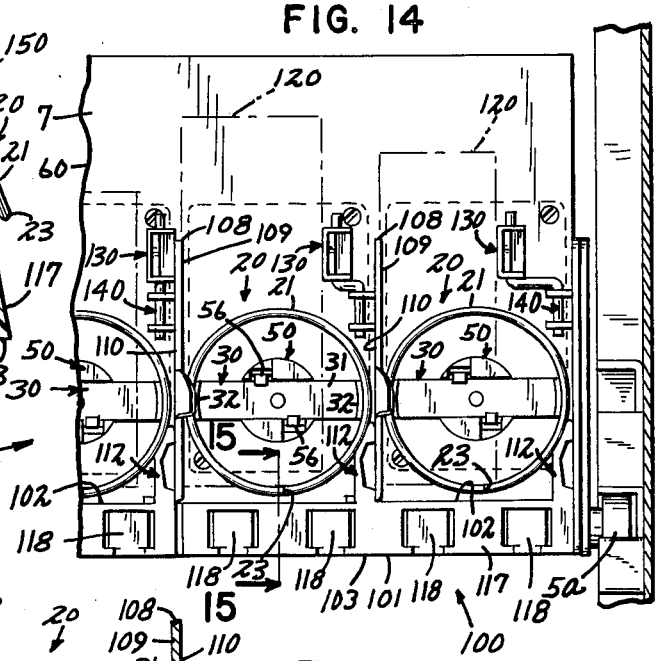
FIG. 14 is a fragmentary view in front elevation of several of the vending coil units and underlying trays disclosed in FIG. 10.
Figure 16:
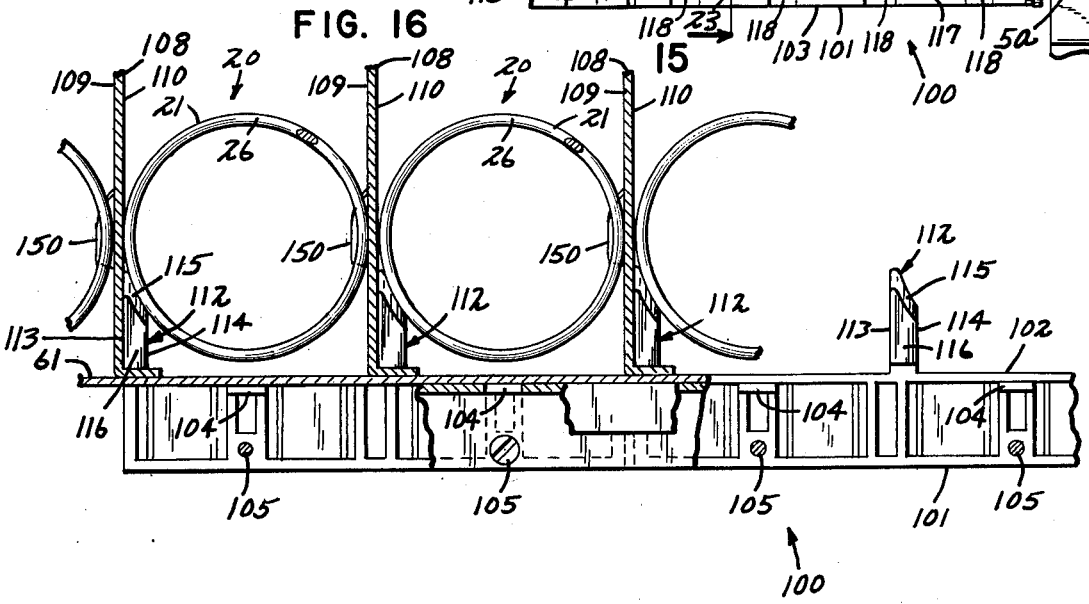
FIG. 16 is a sectional view in rear elevation of the support ramp member disclosed in FIG. 15, generally taken along the Line 16—16 of FIG. 15.

Referring to FIGS. 14, 15 and 16, a second preferred embodiment of a coil support apparatus for supporting the forwardly disposed portion of the dispensing coil 21, is generally illustrated at 100. The coil support apparatus 100 includes a base member 101 having a top planar surface 102 and configured for mounting to the forward end of the tray 3 such that the base member 101 laterally extends across the front edge 62 of the tray shelf 61 with the top planar surface 102 of the base member 101 and the shelf surface 61 of the tray 3 forming a continuous sliding surface. The base member 101 further has a forward, generally vertically disposed end 103. The rearwardly disposed portion of the base member 101 has a mounting flange 104 rearwardly projecting for engagement with the lower side of the shelf 61, and is securely fastened to the forward end 6 of the tray 3 by means of mounting studs 105.

The coil support apparatus 100 further has an upright side panel 108 having a first generally planar side 109 and a second generally planar side 110. The upright side panel 108 is mounted to the shelf 61 and extends from th front portion 6 of the tray 3 to the rear portion 7 thereof. The coil support apparatus 100 further has a coil support member 112 mounted to and projecting generally vertically upward from the upper surface 102 of the base member 101 and extending from the forward end 103 of the base member 101 in a rearward direction generally parallel to the upright side panel 108. The coil support member 112 comprises a first generally vertically extending side portion 113 and a second generally vertically extending side portion 114, terminating at an elongate ramp surface 115 disposed above the shelf surface 61 and inclinded obliquely thereto. The rearwardly disposed trailing edge of the coil support member 112 is also inclined to form a ramp 116 extending at an angle from the first vertically disposed side 113 to the second vertically disposed side 114 of the coil support member 112 and forming a continuous sliding surface with the elongate ramp surface 115.

The upright side panel 108 and the elongate ramp surface 115 of the coil support member 112 are spaced apart a distance relative to one another which is less tha than the outer diameter of the helical coil 21 to be supported thereby, such that the vending coil 21 is cooperatively supported by the elongate ramp surface 115 and the first side 109 of the upright side panel 108 such that the lower surface of the coil 21 is disposed above and spaced apart from the underlying shelf surface 61. In the preferred embodiment, the first vertically disposed side 113 of the coil support member 112 of one dispensing coil unit 20 abuts in supportive manner the second planar surface 110 of the upright side panel 108 of the immediately adjacent dispensing coil unit 20.

The forward end 103 of the second coil support apparatus 100 includes a display panel 117. In the preferred embodiment, the display panel 117 includes a plurality of generally vertically oriented slots 118 suitable for accepting plastic or paper tab inserts (not illustrated) on which visual information such as product identification or price information can be visually displayed.

The coil support apparatus 100 above-described is particularly suitable for accommodating a helical coil 21 having a diameter less than that of the coils supported by the coil support apparatus 70, and is particularly well adapted for use in dispensing smaller items such as candy bars and the like which have packages less bulky than potato chips and pasteries. In operation, the items to be dispensed 120 by means of coils supported by the coil support apparatus 100 would generally be loaded into the dispensing coil 21, by placing the items between the convolutions thereof, in an upright position. To maintain the dispensable items 120 in their upright positions, a panel-like product quide member 130 is used to laterally support the dispensable items between the first side 109 of the upright side panel and the product guide member 130.

Figure 12:
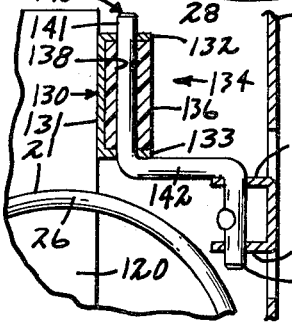
FIG. 12 is a fragmentary sectional view of a portion of the vending coil unit of FIG. 11, illustrating a product to guide arm, and generally taken along the Line 12—12 of FIG. 11.
Figure 13:
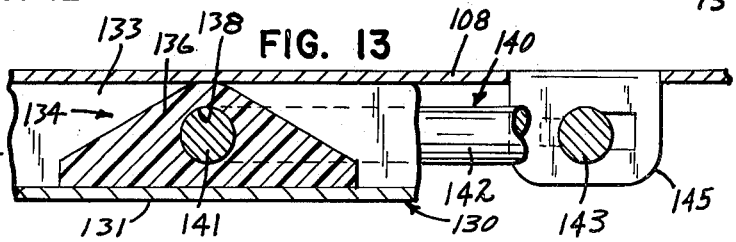
FIG. 13 is an enlarge fragmentary sectional view of a bracket and pivot arm portion of the vending coil unit of FIG. 11, taken generally along the Line 13—13 of FIG. 11.

The product guide 130 is adjustably mounted to accommodate various widths of items to be carried by the coil 21. The product guide 130 comprises a channel shaped member having a side portion 131, a top portion 132 and a bottom portion 133, and extends in overlying manner along the entire length of the dispensing coil 21. The product guide member 130 is pivotally supported at two pivot points 134 and 135 at longitudinally spaced positions along the guide 130. Plastic sleeve members 136 and 137 are positioned between the top and bottom portions 132 and 133 respectively of the guide at the pivot points 134 and 135 respectively, and have vertically extending aperatures 138 and 139 respectively extending therethrough (see FIGS. 11–13).

Each of the product guide members 130 is supported by means of a plurality of pivot arms 140, having an upper vertical portion 141, a horizontally disposed middle portion 142 and a lower vertically disposed portion 143. The lower vertical portion 143 of the pivot arms 140 are mounted to pivotally ride in bracket members 145 mounted to extend from the second side wall surface 110 of that upright side panel 108 of the immediately adjacent coil support apparatus. The upper vertical portions 141 of the pivot arms 140 are inserted through the vertically aligned aperatures 138 and 139 of the plastic sleeve support members 136 and 137 respectively in the product guide 130 and frictionally engage the inner aperature surfaces of the plastic sleeve members 136 and 137, such that the product guide member 130 can be pivotally rotated to the desired lateral spacing from the first side 109 of the upright side panel 108 by rotating the product guide 130 about its pivot points 134 and 135 to the desired location, see FIGS. 10–13. Once the desired location has been attained, the frictional fit between the pivot arms 140 and the sleeve members 136 and 137 will maintain the lateral positioning of the product guide panel 130 until re-adjusted by an operator of the machine.

Each upright side panel 108 has mounted at its forward edge a tab member 150 projecting outwardly therefrom at an angle toward the coil support member 112. In the preferred embodiment, this angle is approximately 30° but may be any other suitable angle. The tab member 150 is preferably vertically positioned at that vertical height where the dispensing coil 21 contacts the side panel 108. The tab member 150 projects outwardly from the side panel 108 a distance sufficient to engage the forward edge of the front winding of the dispensing coil 21, at a position therealong spaced back from the first terminal 23 thereof. As the dispensing coil 21 is rotated during a dispensing operation, the tab member 150 will come into sliding engagement with the first winding of the vending coil 21. In normal operation, the dispensing coil is rotated about its longitudinal axis in a direction opposite to the direction of the coil windings. Therefore, once the coil has come into sliding engagement with the tab member 150, the tab member 150 will impart compressive forces to the dispensing coil 21 in the longitudinal direction of the coil such that further rotation of the coil causes a slight compression of the generally rigid coil 21. When the point of contact between the tab member 150 and the first winding of the coil 21 reaches and passes the first terminal 23 of the vending coil 21, the coil 21 disengages from the tab member 150, relieving the compression and the vending coil 21 rapidly expands to its normal length. The rapid expansion of the dispensing coil to its normal length provides a positive dispensing "push" to that article to be dispensed which is positioned within the first convolution of the dispensing coil, at the forward edge of the tray 3. Upon rapidly expanding, therefore, the dispensing coil 21 effects a vend of the item within its first convolution by positively ejecting that item over the edge of the top planar surface 102 of the base member 101, from whence it falls into the discharge bin 91 of the machine 1 by force of gravity.

While preferred configurations and embodiments of the invention have been disclosed herein, other modifications of the invention will be apparent to those skilled in the art in light of the foregoing description. This description is entended to provide concrete examples of specific embodiments which clearly disclose the present invention. Accordingly, the invention is not limited to any particular embodiment. All alternatives, modifications and variations of the present invention which fall within the spirit and broad scope of the appended claims are covered.

What is claimed is:

1. Mounting apparatus for an elongate helical coil of the type used in dispensing machines, comprising:

a. an elongate helical coil having a longitudinally extending coil axis and defining an internal cylindrical zone coaxial with said coil axis;

b. a cross-bracket member mounted to one end of said coil, having a portion thereof disposed across the diameter of said coil; and c. cross-bracket holding means cooperatively detachably engaging said cross-bracket member for detachably rotatably mounting said coil in quick-release manner for rotation about said coil axis, such that said axis is generally disposed in a horizontal plane, whereby said internal cylindrical zone of the mounted coil is free of obstruction along the longitudinal length of said coil wherein said cross-bracket holding means comprises a stationary housing member; a rotatable member mounted to said stationary housing member and rotatable about a generally horizontally disposed axis, said rotatable housing member comprising a cross-bracket holding device having a recessed channel sized to matingly engage said cross-bracket member, for imparting rotary motion thereto and retaining means mounted for rotation with said rotatable housing member, for releasably securing in quick-release manner said cross-bracket member into cooperative engagement with said recessed channel in said cross-bracket holding device, wherein said retaining means comprises a plurality of retaining clips, positioned on opposite sides of said channel and being operable between first and second positions, said retaining clips being normally biased toward said first position to retainably engage said cross-bracket member within said channel and being movable to said second position for releasing and for accepting said cross-bracket member from and into retention within said channel.

2. Mounting apparatus as recited in claim 1, wherein that portion of said cross-bracket member which is disposed across the diameter of said coil includes a first alignment element, and wherein said cross-bracket holding means includes a second alignment element configured for cooperative self-guided mating engagement with said first alignment element, to provide rapid coaxial alignment of said coil with said cross-bracket holding means.

3. Improved support apparatus for an elongate helical coil of the type used for dispensing articles from dispensing machines, said coil being generally rigid, having first and second longitudinally spaced ends, and being rotatable about its longitudinal axis, comprising:

a. a shelf member defining an upper shelf surface;

b. an upright side panel projecting generally vertically upward from said shelf surface and longitudinally extending therealong in a direction generally perpendicular to one edge of said shelf surface; and c. a coil support member projecting generally vertically upward from said shelf surface with a portion of said coil support member being configured to define an elongate ramp surface disposed above said shelf surface and obliquely inclined to said shelf surface in the longitudinal direction of said coil, said ramp surface being disposed generally parallel to and spaced apart from said side panel at a distance less than the outer diameter of a helical coil to be supported by said support apparatus; whereby said ramp surface and said side panels are cooperatively operable to support the helical coil therebetween only adjacent a first end of the coil, such that the lower surface of said coil is disposed above and spaced apart from said shelf surface.

4. An improved coil support apparatus as recited in claim 3, further including means configured to releasably engage the coil supported by said support apparatus along at least one convolution thereof for selectively imparting compressive forces to the helical coil as it rotates about its longitudinal axis.

5. An improved coil support apparatus as recited in claim 4, wherein said coil compressing means comprises a tab member fixedly mounted to said side panel and projecting outwardly therefrom at an angle, said tab member being disposed along the length of said side panel so as to slidably engage at least one of the convolutions of the coil supported by said support apparatus, in a manner such that as the coil is rotated about its longitudinal axis in a direction opposite to the direction of the coil windings, said tab member imparts compressive forces to the coil in the longitudinal axial direction of the coil.

6. An improved coil support apparatus as recited in claim 5, wherein said support apparatus is configured such that said first end of said coil being supported thereby extends slightly beyond said one edge of said shelf surface, wherein said side panel member has a portion thereof disposed to longitudinally extend beyond said one edge of said shelf member, and wherein said tab member is connected to said side panel member so as to slidably engage the first convolution adjacent the one end of the coil in a manner such that as the coil rotates in a direction opposite to that direction of the coil windings, the coil is longitudinally compressed by sliding engagement with said tab member until said first end of the coil clears said tab member, whereby the coil rapidly expands toward its predetermined uncompressed configuration.

7. An improved coil support apparatus as recited in claim 3, wherein said coil support member is sized such that said ramp surface thereof cooperatively engages the convolutions of only a relatively short portion of the overall length of the supported coil, adjacent said first end thereof.

8. An improved coil support apparatus as recited in claim 7, wherein said coil support member defines a first end disposed to lie adjacent said one edge of said shelf surface and defines a second end longitudinally spaced from said first end along said ramp surface, wherein said second end defines a second ramp surface inclined to the general plane of said coil support member, whereby the general plane of said second ramp surface is disposed to lie generally perpendicular to said shelf surface and provides a smooth continuum with said first ramp surface.

9. Improved support apparatus for rotatably mounting an elongate semi-rigid helical coil, of the type used for dispensing articles from a dispensing machine, above a shelf surface having a front edge, comprising:

a. a first elongate coil support member characterized by a base portion configured for mounting in resting engagement upon a shelf surface and defining a first planar upper surface disposed to lie above and generally parallel to the shelf surface adjacent to only the front edge thereof, said first upper surface being terminated at first and second longitudinally opposed ends thereof, wherein said first end of said first support member defines a first ramp surface forming an inclined continuum in the longitudinal direction of said first coil support member between the shelf surface and said first upper surface;

b. a second elongate coil support member characterized by a base portion configured for mounting in resting engagement upon the shelf surface adjacent to only the front edge thereof and defining a second planar upper surface disposed to lie above and generally parallel to the shelf surface, said second upper surface being terminated at first and second longitudinally opposed ends thereof, wherein said first end of said second support member defines a second ramp surface forming an inclined continuum in the longitudinal direction of said second coil support member between the shelf surface and said second upper surface, and wherein the longitudinal length of said second support member is less than that of said first support member; and c. means for fixedly connecting said first and said second coil support members in spaced, generally parallel relationship to one another such that said first and said second ramp surfaces lie generally in the same plane, whereby said first and said second coil support members are spaced apart from one another to cooperatively support a helical coil on and between said first and said second upper surfaces such that the lower surface of the supported coil is disposed to lie above and spaced apart from the shelf surface.

10. Improved coil support apparatus as recited in claim 9, wherein said base portion of said first coil support member is configured to mount in resting engagement upon the shelf surface such that said second end of said first support member outwardly projects beyond the front edge of the shelf; and wherein said connecting means is configured to mount said second support member to the shelf surface such that said second end of said second support member lies closely adjacent the front edge of the shelf.

11. Improved coil support apparatus as recited in claim 10, wherein the longitudinal length of said first support member exceeds that of said second support member by approximately the longitudinal distance between consecutive convolutions of the helical coil supported by the apparatus.

12. Improved coil support apparatus as recited in claim 10, wherein said connecting means comprises a narrow beam member generally perpendicularly disposed between said base portions of said first and second coil support members, wherein said beam member is configured to matingly engage the front edge of the shelf to which the support apparatus is mounted in a manner such that the top surface of said beam member is generally co-planar with the shelf surface and forms a continuous surface therewith.

13. Improved coil support apparatus as recited in claim 9, wherein the lateral dimension of the first planar upper surface of said first elongate coil support member is substantially larger than the lateral width of the second planar upper surface of said second elongate coil support member.

14. In a dispensing machine of the type having a plurality of dispensing units mounted in generally parallel relationship to one another on a dispensing tray of the machine, wherein the tray defines an upper shelf surface and has a front edge at which items are dispensed from the dispensing units, wherein at least one of the dispensing units includes an elongate semi-rigid helical dispensing coil having longitudinally disposed first and second ends defining an internal cylindrical zone therebetween and means for selectively rotating the coil about its longitudinal axis, wherein the rotation means includes a rotatable output shaft mounted for coaxial alignment with the helical coil, the invention being characterized by improved mounting apparatus for the helical dispensing coil, comprising:

a. a cross-bracket member attached to the first end of the dispensing coil, having a portion thereof disposed across the diameter of the coil;

b. a cross-bracket holding member mounted to the rotatable shaft for rotation therewith, configured to cooperatively matingly engage said cross-bracket member for detachably rotatably mounting in quick-release manner the first end of the coil for rotation thereof about its longitudinal axis, such that the lower surface of the front end of the coil is mounted above and slightly spaced apart from the upper shelf surface of the tray; and c. support means mounted on the tray adjacent the front edge thereof for rotatably supporting said coil adjacent only said second end thereof, said support means slidably supportingly engaging the outer circumference of the coil such that the lower surface of the coil is disposed above and slightly spaced apart from the shelf surface, and in a manner enabling unimpeded dispensing of items from the second end of the coil at the front edge of the tray, wherein said internal cylindrical zone is free of obstruction along the longitudinal length of said coil wherein said forwardly disposed support means further comprises first and second support ramp members mounted adjacent the front edge of the tray and extending rearwardly therefrom in a spaced apart generally parallel manner, each of said first and second ramp members being characterized by front and rear portions wherein said rear portions of said first and second ramp members are angularly inclined from said shelf surface upwardly in the longitudinal direction of the front edge of the tray, to upper coil support surfaces of each of said first and second ramp members, and wherein said front portion of said first ramp member is disposed to project outwardly from the front edge of the tray and forward of said front portion of said second ramp member said first and second support members being configured to supportingly engage the coil only along a short length thereof adjacent said second end of said coils.

15. Improved coil mounting apparatus as recited in claim 14, wherein said cross-bracket holding member includes a recessed channel sized to matingly engage said cross-bracket member, for imparting rotary motion thereto, and retaining members mounted to the cross-bracket holding member adjacent said recessed channel for releasably securing said cross-bracket member into cooperative engagement with said recessed channel in said cross-bracket holding device.

16. Improved coil mounting apparatus as recited in claim 15, wherein that portion of said cross-bracket member which is disposed across the diameter of the coil includes a first alignment aperature coaxially aligned with the longitudinal axis of the coil, and wherein said cross-bracket holding member engages the rotatable output shaft of the rotation means such that the rotatable output shaft projects outwardly from said cross-bracket holding member and addresses the first end of the coil, such that the projecting end of the rotatable shaft cooperatively mates with the alignment aperature in said cross-bracket member to provide rapid self-guided coaxial alignment of the coil with the rotatable shaft.

17. Improved coil mounting apparatus as recited in claim 14, wherein said inclinded rear portions of said first and second ramp members are generally co-planar.

18. Improved coil mounting apparatus as recited in claim 14, wherein said front portion of said first ramp member longitudinally projects beyond the front edge of the tray and forward of said front portion of said second ramp member a distance approximating the longitudinal distance between consecutive convolutions of the helical coil supported by said mounting apparatus.

19. Improved coil mounting apparatus as recited in claim 14, further including a plurality of shelf divider panels mounted to the tray and vertically projecting from the upper shelf surface of the tray to separate adajcent ones of the dispensing units, and wherein at least one tray of the machine includes a plurality of said coil mounting apparatus, aligned in parallel and adjacent one another on opposite sides of said shelf dividing panels.

20. In a dispensing machine of the type having a plurality of dispensing units mounted in generally parallel relationship to one another on a dispensing tray of the machine, wherein the tray defines an upper shelf surface and has a front edge at which items are dispensed from the dispensing units, wherein at least one of the dispensing units includes an elongate semi-rigid helical dispensing coil having longitudinally disposed first and second ends defining an internal cylinderical zone therebetween and means for selectively rotating the coil about its longitudinal axis, wherein the rotation means includes a rotatable output shaft mounted for coaxial alignment with the helical coil, the invention being characterized by improved mounting apparatus for the helical dispensing coil, comprising:

a. a cross-bracket member attached to the first end of the dispensing coil, having a portion thereof disposed across the diameter of the coil; b. a cross-bracket holding member mounted to the rotatable shaft for rotation therewith, configured to cooperatively matingly engage said cross-bracket member for detachably rotatably mounting in quick-release manner the first end of the coil for rotation thereof about its longitudinal axis, such that the lower surface of the front end of the coil is mounted above and slightly spaced apart from the upper shelf surface of the tray; and c. support means mounted on the tray adjacent the front edge thereof for rotatably supporting said coil adjacent only said second end thereof, said support means slidably supportingly engaging the outer circumference of the coil such that the lower surface of the coil is disposed above and slightly spaced apart from the shelf surface, and in a manner enabling unimpeded dispensing of items from the second end of the coil at the front edge of the tray, wherein said internal cylindrical zone is free of obstruction along the longitudinal length of said coil, wherein said forwardly disposed support means comprises an upright side panel projecting generally vertically upward from the tray shelf surface and longitudinally extending therealong in a direction generally perpendicular to the front edge of the tray; and a coil support member projecting generally vertically upward from the shelf surface with a portion of said coil support member being configured to define an elongate ramp surface disposed above the shelf surface and obliquely inclined in the longitudinal direction of said coil support member thereof, said ramp surface being disposed generally parallel to and spaced apart from said side panel at a distance less than the outer diameter of the helical coil, whereby said ramp surface and side panel cooperatively support the helical coil therebetween such that the lower surface of the coil is disposed above and spaced aparat from the shelf surface.

21. Improved coil mounting apparatus as recited in claim 20, wherein said coil support member is mounted adjacent the front edge of the tray and is sized such that said ramp surface thereof cooperatively engages the outer circumference of the convolutions of only a relatively short portion of the overall length of the supported coil near its second end.

22. Improved coil mounting apparatus as recited in claim 21, wherein said coil support member defines a first end disposed to lie adjacent the front edge of the tray and defines a second end longitudinally spaced from said first end along said ramp surface, wherein said second end defines a second ramp surface inclinded to the general plane of said coil support member, whereby the general plane of said second ramp surface is disposed to lie generally perpendicular to the tray shelf surface and provides a smooth continuum with said first ramp surface.

23. Improved coil mounting apparatus as recited in claim 20, further including means mounted to said forwardly disposed coil support means and configured to releasably engage the coil along at least one convolution thereof for selectively imparting compressive forces to the helical coil as it rotates about its longitudinal axis.

24. Improved coil mounting apparatus as recited in claim 23, wherein said coil compressing means comprises a tab member fixedly mounted to said guide panel and projecting outwardly therefrom at an angle, said tab member being disposed to slidably engage at least one of the convolutions of the dispensing coil in a manner such that as the coil is rotated about its longitudinal axis in a direction opposite to the direction of the windings of the dispensing coil, said tab member imparts compressive forces to the coil in the longitudinal axial direction of the coil.

25. Improved coil mounting apparatus as recited in claim 20, further including a plurality of said upright saide panel members and said coil support members mounted generally parallel to one another on the dispensing tray in alternating fashion and extending generally perpendicularly back from the front edge of the tray, forming a plurality of helical dispensing coil support members upon a single dispensing tray.

26. Improved coil mounting apparatus as recited in claim 25, further including product guide means pivotally mounted to the back portion of said side panel of that adjacently disposed dispensing unit for guiding the longitudinal motion of items placed within and projecting above the convolutions of the dispensing coil, said product guide means including an elongate generally planar guide member pivotally mounted to longitudinally extend above and spaced apart from the dispensing coil and being pivotally movable in the lateral direction with respect to the longitudinal axis of the coil.

* * * * *

UNITED STATES PATENT AND TRADEMARK OFFICE

CERTIFICATE OF CORRECTION

PATENT NO. : 4,061,245

DATED : December 6, 1977

INVENTOR(S) : Joseph A. Lotspeich

It is certified that error appears in the above-identified patent and that said Letters Patent are hereby corrected as shown below:

In column 2, line 22, "fron" should read --from--.

In column 4, line 32, after the word "top" please insert the word --support--.

In column 4, line 54, the word "cnetral" should read --central--.

In column 8, line 12, the word "th" should read --the--.

In column 16, line 28, "saide" should be --side--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*